United States Patent [19]

Larsson et al.

[11] Patent Number: 4,687,197

[45] Date of Patent: Aug. 18, 1987

[54] EXERCISE APPARATUS WITH DUAL PIVOTAL MOTION AND CYLINDER RESISTANCE ASSEMBLY

[76] Inventors: Lars Larsson, P.O. Box 7266, Laguna Niguel, Calif. 92677; Bengt Svesson, Bromåla, 37193 Karlskrona, Sweden

[21] Appl. No.: 490,840

[22] Filed: May 2, 1983

[51] Int. Cl.[4] ..... A63B 69/06

[52] U.S. Cl. ..... 272/72; 272/130

[58] Field of Search ..... 272/130, 73, 134, 140, 272/143, 72, 93, 96, 136, 142

[56] References Cited

U.S. PATENT DOCUMENTS

| | | | |
|---|---|---|---|
| 580,420 | 4/1897 | Nickerson | 272/72 |
| 3,792,860 | 2/1974 | Selnes | 272/72 X |
| 3,822,599 | 7/1974 | Brentham | 272/130 X |
| 3,848,870 | 11/1974 | Craig | 272/73 X |
| 4,140,312 | 2/1979 | Buchmann | 272/73 |
| 4,169,591 | 10/1979 | Douglas | 272/73 |
| 4,240,627 | 12/1980 | Brentham | 272/130 |
| 4,247,098 | 1/1981 | Brentham | 272/130 |
| 4,357,010 | 11/1982 | Telle | 272/130 |
| 4,397,462 | 8/1983 | Wilmarth | 272/130 |
| 4,426,077 | 1/1984 | Becker | 272/136 X |

FOREIGN PATENT DOCUMENTS

| | | | |
|---|---|---|---|
| 605957 | 11/1934 | Fed. Rep. of Germany . | |
| 1097873 | 1/1961 | Fed. Rep. of Germany . | |
| 150850 | 4/1981 | German Democratic Rep. . | |
| 825121 | 3/1979 | U.S.S.R. . | |
| 886916 | 12/1981 | U.S.S.R. | 272/130 |

*Primary Examiner*—Richard J. Apley
*Assistant Examiner*—Robert W. Bahr
*Attorney, Agent, or Firm*—Spensley, Horn, Jubas & Lubitz

[57] ABSTRACT

The present invention relates to exercise equipment, more particularly to an exercise machine that gives the exerciser a variety of movements based on a single concept (that of the pivot), working the whole body without having to change equipment. The apparatus includes a frame having a seat, a vertically extending rod pivotally coupled to the frame and a handle pivotally coupled to the end of the rod. The dual pivoting connections facilitate an exercise movement similar to the paddling motion used with a kayak.

12 Claims, 4 Drawing Figures

EXERCISE APPARATUS WITH DUAL PIVOTAL MOTION AND CYLINDER RESISTANCE ASSEMBLY

BACKGROUND OF THE INVENTION

1. Field of the Invention

The present invention is directed to an exercise machine that works on the principal that the upper body, abdominals, and mid-section of the human body are firmed and stretched by the implementation of an exercise which incorporates them all at the same time.

2. Description of the Prior Art

Previous exercise machines have attempted to accomplish the desired motion by the implementation of an exercise or exercises that move the muscles of the arms and shoulders in a forward and back motion such as in what is known at "rowing".

SUMMARY OF THE INVENTION

The present invention uses the basic principle of employing a rowing action but goes even further by implementing a motion which while going forth and back, goes at the same time side to side, thus becoming a pivot. This is akin to the rowing motion used in a kayak. The pivot motion makes the exercise more complete and precise, thus more effective.

In addition to this basic movement, the present invention offers a medium for the exercise of the muscles of the legs and thighs, hips and hip sockets, abdominals and feet using the pivot in another basic movement, that of the "bicycle". While the bicycle movement moves the legs in a forward and back parallel direction, the pivoting motion once again widens the scope of movement to allow for a rotation of the hip socket, thus offering a stretch and toning device for the thigh muscles and abdominals.

Another feature of the present invention is that it provides a means to exercise the muscles of the upper thigh and lower leg as well as the feet, this being possible by the provision of a resistance spring which offers a push/pull motion to be performed by the legs.

The present invention offers options to the exerciser of varying degrees of resistance without the need for attachments. It is a portable, lightweight machine that in essence offers exercise to the whole body. Many of the exercises are not possible on other exercise machines. The scope of exercise is not limited to the following descriptions. There are other, as yet undocumented exercises and variations of such, which are facilitated by the unique structure of the present invention.

BRIEF DESCRIPTION OF THE DRAWINGS

The invention will now be described with reference to the accompanying drawings, wherein.

DESCRIPTION OF THE PREFERRED EMBODIMENT

Figure 1:
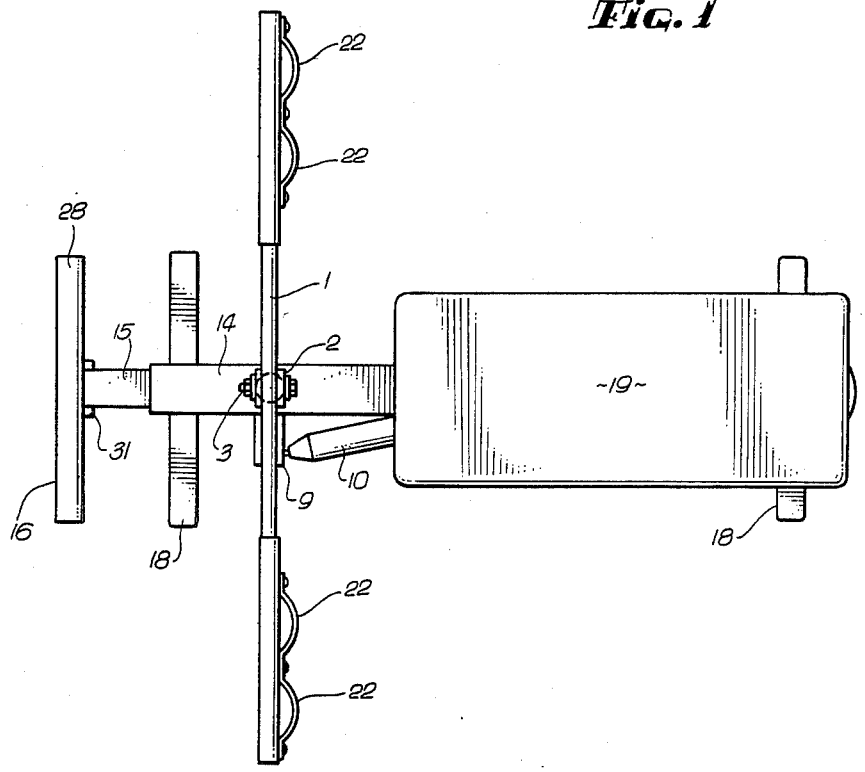
FIG. 1 is a top plan view of the exercise device of the present invention.
Figure 2:
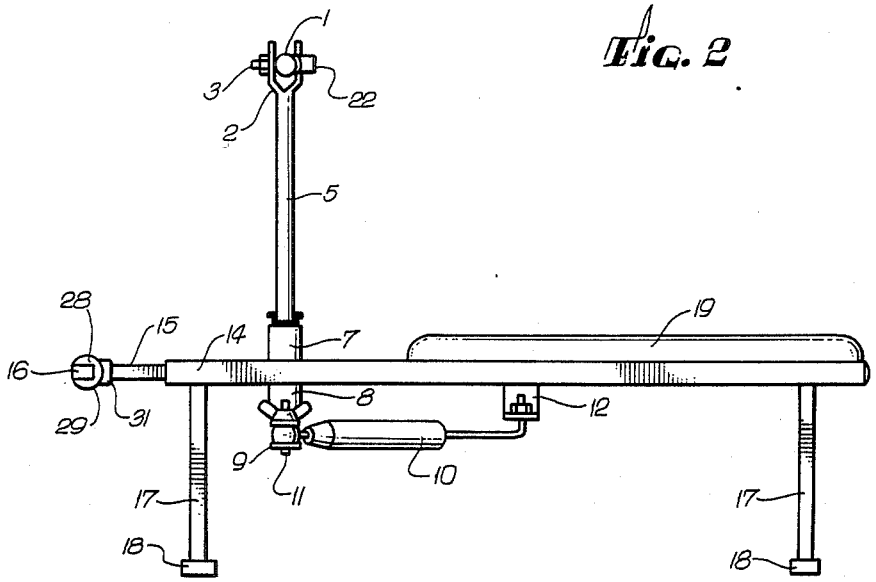
FIG. 2 is a side plan view of the exercise device of the present invention.

Referring to the drawings, a handle 1 is fitted into a fork 2. The handle and fork are fitted together with a nut and a bolt assembly 3. This structure allows the handle 1 to move freely from side to side, i.e. to pivot about the axis of the nut and bolt assembly 3.

Rod 5 is a rod to which the fork 2 is attached. The rod 4 is fitted into metal tubes 7 and 8 which extend from the top and bottom of a square metal frame section 14, respectively. The rod 5, when inserted into the tubes 7 and 8, can move freely in a circular movement. The side to side movement of the handle 1 about the axis of the nut and bolt assembly 3 combined with the circular movement of the rod 4 creates an overall pivoting action similar to that encountered when paddling a kayak.

Figure 3:
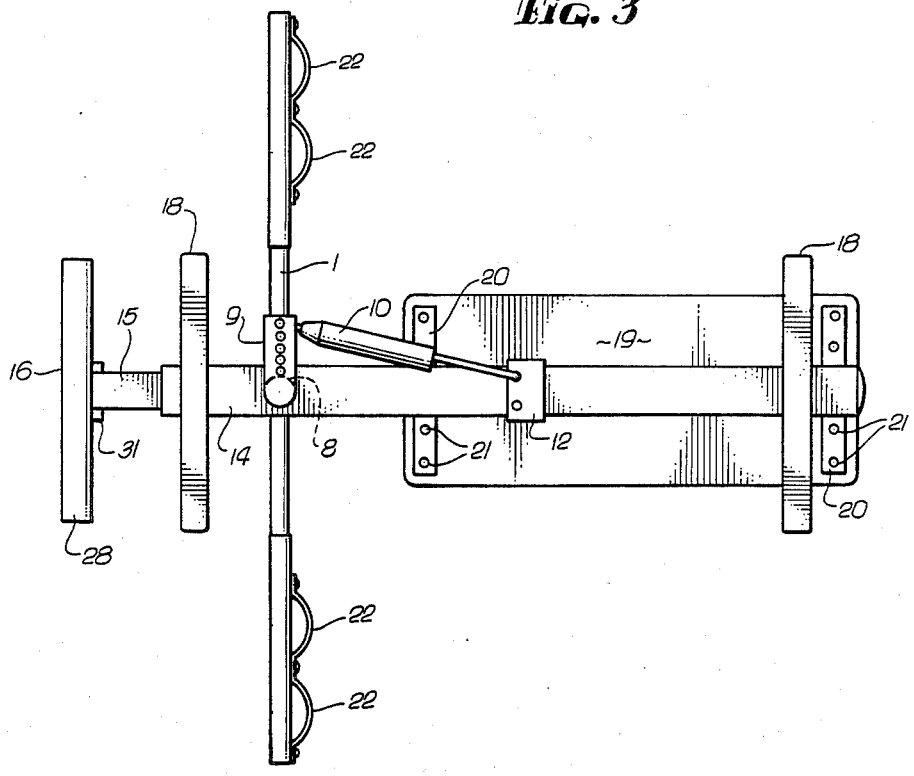
FIG. 3 is a bottom plan view of the exercise device of the present invention.

The provision of a resistance cylinder 10 and associated bracket 12, along with a fast release pin 11, facilitate variations of tension in which to perform the machine's functions. By equipping a bracket 9 for coupling the cylinder 10 to the tube 8 with five different settings ranging from heavier to lighter resistance, no addition or subtraction of attachments is required. The bracket 9 is illustrated in FIG. 3.

When the resistance cylinder 10 is extended to its fullest (away from the frame of the machine) the release pin 11 is inserted in the point on the bracket 12 known as the number five setting. That is, the end of the cylinder 10 is aligned with the point in the bracket marked with a numeral five and joined with the release pin. The same is true for lighter tension settings, in which the cylinder 10 is moved closer to the frame and starting with number four moved down to one. For purposes of clarity the number of settings of the bracket 9 are not shown in the drawings, although it is to be understood that the number one setting is that closes to the frame 14.

Figure 4:
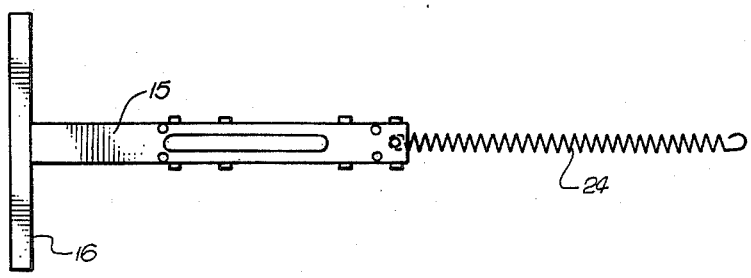
FIG. 4 is a plan view of an end member and foot rest along with a resistance spring.

Another feature of the present invention is the resistance offered for use on the leg muscles through provision of a resistance spring 24 (FIG. 4). This spring is situated inside of the frame 14 and end member 15. It is held on by a nut and a bolt (not shown) on either end of the spring. End member 15 is surrounded by eight plastic bushngs which provide a smooth sliding action. When end member 15 is pressed by the legs away from the frame 14, the spring is expanded thereby offering resistance. When the end member 15 is allowed to pull back toward frame 14, the spring is contracted thereby releasing the tension.

The following is a brief description of various parts of the device shown in the drawings:

Element 1 is a circular rod. It can be made of metal, wood, heavy plastic, or any hard, durable material. This piece has two functions. It serves as a handle or oar and holds stirrups 22, and is the medium which is acted upon in several exercises described below.

Element 16 is formed of square metal tubing. When attached horizontally to the end member 15, it serves as a foot rest and support for all exercises.

Element 17 is square metal tubing which is the leg and support for the machine. This part is welded onto part 14.

Element 18 is square metal tubing which is the foot and support for the machine. This part is welded onto part 17.

Element 19 is a rectangular plywood structure which serves as a seat and/or back/chest support for all exercises. This part is secured onto the frame 14 by brackets 20 (FIG. 3) and rivets 21. It is padded with foam and covered by a strong pliable material such as leather, canvas, nylon, or vinyl.

Stirrups or straps 22 are constructed of any strong pliable material such as canvas, vinyl, leather, or nylon that are secured to the handle 1. There are two straps with a divider in the middle of each forming two stirrups at each end of the handle.

Element 28 is foam padding. This padding is folded around part 16 and serves as protection and comfort for the ankles and feet in all exercises involving the foot support.

The padding is surrounded by strong pliable material 29 such as vinyl, nylon, canvas, or leather.

Rubber bumpers 31 are placed on the end of part 15 at the pivot where parts 14 and 15 meet when exercises involving the resistance spring 24 are performed. This part 31 cushions the impact caused when the resistance spring is contracted, thereby reducing noise and protecting the metal material from which the machine is made. This part also maintains a gap between the two pieces which lessens the occurrence of injury should hands or fingers get in the way during the contraction.

Following is a description of various exercises which may be performed with the apparatus of the present invention.

The difficulty of exercises involving the handle 1 and stirrups 22 may be varied by depressing the fast release pin 11, thereby altering the resistance. The tension may be increased by using a higher number and decreased by selecting a lower number.

A. Basic Exercise

The exerciser seats themselves on the seat 19 and places his/her feet onto the foot support 16 (the knees may be either straight or bent). The hands are placed on either end of the handle 1 and a back and forth and side to side (pivot) motion is begun using the upper torso and at the same time contracting the abdominals and stretching the muscles of the back. This exercise includes alternately moving the hands away from and then toward the body. It is recommended that a moderate to fast pace be maintained to achieve maximum results. This motion is similar to the paddling motion in a kayak.

B. Basic Exercise—Side to Side

The same posture as in Exercise A is assumed then a side to side motion (alternately moving the ends of the handle 1 toward and away from the floor) using the muscles of the mid-section or waist is begun. The abdominals should be contracted and the arms should remain straight throughout the exercise. The exerciser should attempt to feel a strong stretch through the back and shoulders. The pivot motion of the rod 5 in the tubes 7 and 8 is not implemented during this exercise.

C. "Bicycle"—Parallel—Outer Stirrup

The exerciser assumes a position which places him/her lying on his/her back with the feet in the outer stirrup of the handle 1. A "bicycle" like movement is begun pushing one leg back toward the body, and so on, alternating leg to leg. The exercise is then reversed with the legs going in the opposite position that they started. This exercise is done in what is known as the "parallel" position, that is, with the feet pointing straight ahead. It is recommended that a moderate to fast pace be maintained to achieve maximum reuslts.

D. "Bicycle"—Turn Out—Outer Stirrup

The same movement as in Exercise C is performed with the legs rotating outward at the hip sockets thus assuming a position known as "turn out". The heels should be pointing towards each other with the toes pointing to either side.

E. "Bicycle"—Parallel—Inner Stirrup

The same movement described in Exercise C is performed using the inner stirrup. This movement places the legs closer together thereby working the muscles of the abdomen and gluteus maximus, allowing for a tighter contraction of both.

F. "Bicycle"—Turn Out—Inner Stirrup

The same movement described in Exercise D is performed using the inner stirrup. This movement places the legs closer together thereby working the muscles of the abdomen, gluteus maximius, and calves, allowing for tighter contraction and a greater stretch through the calves.

G. Side to Side Leg Stretch—Inner Stirrup

The Exerciser assumes the same position as described in Exercise C, only the movement is done in a side to side pattern only. The pivot of the rod 5 in the tubes 7 and 8 is not implemented in this movement.

H. Side to Side Leg Stretch—Outer Stirrup

The Exerciser assumes the same position as decribed in Exercise G, only the movement is done in a side to side pattern only. The Outer Stirrup is used in this exercise. The pivot of the rod 5 in the tubes 7 and 8 is not implemented in this movement.

I. Sit-Up Exercise Using Foot Support

The Exerciser lies on their back with the feet resting underneath the foot support 16. With the hands placed behind the head, he/she raises the upper torso and touches the knees with the elbows and returns to the original position. This exercise is good for the abdominals and lower back and for those with less endurance, may be done with the arms extended in front of the body instead of behind the head. This exercise should be repeated several times for best results.

J. The same position as in Exercise I is assumed except that the feet are placed in the inner stirrup in a parallel position. The movement will be quite small in this exercise but is very good for strengthening the lower back and abdominals.

K. Spring Resistance Exercise

The Exerciser seats themselves on the seat 19 with the hips as close to the edge facing the handle 1 as possible and places his/her feet on the foot support. With the muscles of the upper thighs and calves, the feet are pushed outward away from the body against the inward pull which results from the resistance spring 24. This push or stretch/contract motion should be done several times for best results.

L. Ankle/Arch Stretch

The Exerciser lays on their stomach with the bottoms of the feet resting on the foot support 16, toes pointing down, legs in parallel position. He/She then pushes outward as in Exercise K. The resistance spring 24 will offer tension as the arches, ankles, and achilles tendons are worked. This movement is small but quite beneficial for weak arches and short lower leg muscles.

M. Lower Back and Chest Stretch

The Exerciser assumes the same position as in Exercise L, feet pointing down in the parallel position. With the hands places behind the head, he/she raises the upper torso while at the same time contracting the muscles of the glulteus maximus. This position should be held for at least five seconds, then the torso should be relaxed back down to the starting position. This exercise strengthens the lower back while at the same time offers a means of expanding the chest and should be repeated several times for best results.

We claim:

1. An exercise apparatus comprising:

a frame section including seat means for supporting an exerciser in a position in which the exerciser is aligned with a vertical central plane of the frame section so that the right side of the exerciser is to one side of the central plane and the left side of the exerciser is to the other side of the central plane;

a rod;

means on the frame section for supporting the rod for rotation with respect to the longitudinal axis of the rod and for otherwise maintaining the rod stationary, said rod having a free end located in the central plane;

a single elongated handle pivotally secured at the midpoint thereof to the free ends, both of which are contacted by the exerciser, and wherein said handle is pivotal about an axis which is perpendicular to the longitudinal axis of the rod and perpendicular to the longitudinal axis of the handle; and resistance means including at least one resistance cylinder means for providing resistance to the movement of the handle.

2. An exercise apparatus as in claim 1 wherein the resistance means includes a bracket extending from the rod and wherein the cylinder assembly is connected between the bracket and the frame section.

3. An exercise apparatus as in claim 1 wherein the frame section comprises a horizontally extending tubular element having an open end, a seat secured to the tubular element, at least one leg for supporting the tubular element above an exercise floor, a T-shaped member having the leg thereof slidably supported in the tubular element, and second resistance means coupling the T-shaped member to the tubular element to bias the T-shaped member toward the tubular element.

4. An exercise apparatus as in claim 1 wherein said resistance means is adjustable to provide a variable amount of resistance.

5. An exercise apparatus as in claim 4 wherein the cylinder assembly includes a cylinder having a first end which is fixed with respect to the handle and a second end which is connected to move in conjunction with movement of the handle.

6. An exercise apparatus as in claim 4 wherein the cylinder means includes a cylinder having a first end which is fixed with respect to the handle and a second end which is connected to move in conjunction with movement of the handle.

7. An exercise apparatus comprising:

a foundation including seat means for supporting an exerciser in a position in which the exerciser is aligned with a vertical central plane of the foundation so that the right side of the exerciser is to one side of the central plane and the left side of the exerciser is to the other side of the central plane;

a rod;

means on the foundation for supporting the rod in a fixed location, wherein the rod is rotatable with respect to its longitudinal axis and has a free end located in the central plane;

a single elongated handle pivotally secured at a midpoint thereof to the free end of the rod, wherein the exerciser contacts the handle on both sides of the midpoint, and wherein said handle is pivotal about an axis which is perpendicular to the longitudinal axis of the rod and perpendicular to the longitudinal axis of the handle, whereby the handle is movable to simulate a paddling motion; and resistance means including at least one resistance cylinder means for providing resistance to the movement of the handle.

8. An exercise apparatus according to claim 7 wherein the means for supporting the rod includes a stationary tubular element within which the rod is rotatably supported, wherein the rod is fixed with respect to the tubular element to prevent any translational movement of the rod.

9. An exercise apparatus as in claim 7 wherein said resistance means is adjustable to provide a variable amount of resistance.

10. An exercise apparatus comprising:

a foundation including seat means for supporting an exerciser in a position in which the exerciser is aligned with a vertical central plane of the foundation so that the right side of the exerciser is to one side of the central plane and the left side of the exerciser is to the other side of the central plane;

a rod;

support means on the foundation for (a) supporting the rod so that the rod is rotatable with respect to its longitudinal axis and has a free end located in the central plane and (b) preventing any movement of the rod other than said rotation during exercising; and a single elongated handle pivotally secured at a midpoint thereof to the free end of the rod, wherein the exerciser contacts the handle on both sides of the midpoint, and wherein said handle is pivotal about an axis which is perpendicular to the longitudinal axis of the rod and perpendicular to the longitudinal axis of the handle, whereby the handle is movable to simulate a paddling motion; and resistance means including at least one resistance cylinder means for providing resistance to the movement of the handle.

11. An exercise apparatus as in claim 10 wherein said resistance means is adjustable to provide a variable amount of resistance.

12. An exercise apparatus as in claim 11 wherein the cylinder means includes a cylinder having a first end which is fixed with respect to the handle and a second end which is connected to move in conjunction with movement of the handle.

* * * * *